US005154502A

United States Patent [19]

Takaoka

[11] Patent Number: 5,154,502

[45] Date of Patent: Oct. 13, 1992

[54] PARTITION WALL SEALING STRUCTURE FOR THERMALLY INSULATED BOX

[75] Inventor: Mitsuyuki Takaoka, Toyoake, Japan

[73] Assignee: Hoshizaki Denki Kabushiki Kaisha, Toyoake, Japan

[21] Appl. No.: 649,574

[22] Filed: Feb. 1, 1991

[30] Foreign Application Priority Data

Feb. 6, 1990 [JP] Japan ..... 2-10203[U]

[51] Int. Cl.[5] ..... A47B 47/04

[52] U.S. Cl. ..... 312/407; 312/406.2

[58] Field of Search ..... 312/214, 296, 406.2, 312/407; 220/430, 467

[56] References Cited

U.S. PATENT DOCUMENTS 3,642,164 2/1972 O'Neal et al. ..... 312/214 X 3,726,578 4/1973 Armstrong ..... 312/214

*Primary Examiner*—Joseph Falk

*Attorney, Agent, or Firm*—Brooks Haidt Haffner & Delahunty

[57] ABSTRACT

A sealing structure, adapted to be fitted in a gap between a wall surface of a thermally insulated box and a partition wall, includes a rigid main body portion supported by the partition wall, a plurality of flexible seal members integrally formed with the main body portion and extending therefrom, and an engaging part formed in the main body portion. When the structure is mounted in the gap, the engaging part engages the partition wall to thereby allow the main body portion to be supported by the partition wall, while some of the plural seal members abut on the inner wall surface of the thermally insulated box to thereby define a plurality of hollow spaces in cooperation with the main body portion of the seal structure and the wall surface of the thermally insulated box.

5 Claims, 3 Drawing Sheets

PARTITION WALL SEALING STRUCTURE FOR THERMALLY INSULATED BOX

BACKGROUND OF THE INVENTION

1. Field of the Invention

The present invention generally relates to a sealing structure employed in a thermally insulated box and, more particularly, to a sealing structure to be disposed in a gap between an inner wall surface of the thermally insulated box and a partition wall mounted within the box for dividing the interior space thereof into a plurality of compartments or chambers of different temperature conditions.

2. Description of the Prior Art

FIG. 5 of the accompanying drawings shows in a vertical sectional view a structure of a box-like body of a freezer/refrigerator unit equipped with a conventional partition wall sealing structure. Referring to FIG. 5, the interior space of a thermally insulated box-like body 1 having enclosure walls filled with foamed polystyrene resin also referred to as foamed styrol is divided into a freezing chamber 3 and a refrigerating chamber 4 by means of a partition wall 2. Reference symbols 3*a* and 4*a* denote front openings of the freezer/refrigerator which can be closed by doors (not shown) mounted pivotally.

FIG. 6 is an enlarged sectional view showing a region indicated by symbol A in FIG. 5. The partition plate 2, the interior of which is filled with foamed polystyrol, is supported within the thermally insulated box 1 by means of an angle member 5 fixedly secured to the thermally insulated box 1 by screws. A heat insulating packing 6 of a flexible or deformable material is interposed between the partition plate 2 and the thermally insulated box 1. Provided at a corner portion located between a rear wall surface 1*a* of the thermally insulated box 1 and the partition plate 2 is a caulking material 7 for filling any gaps possibly present between the thermally insulated box 1 and the partition plate 2 while preventing the heat insulating packing 6 from being exposed to the freezing compartment 3.

With the structure for sealing the partition wall described above, the caulking material 7 must be applied along the width of the partition wall 2 (i.e. in a direction perpendicular to the plane of FIG. 6). Consequently, when the region that the caulking material 7 is to be applied is very long as in the case of a large size freezer/refrigerator unit, troublesome and time consuming procedures are involved for the caulking, while skill is required to apply the caulking material.

Further, since the amount of moisture absorbed by the heat insulating packing 6 tends to increase during use of the freezer/refrigerator unit over an extended period of time, the heat insulation effect between the freezing compartment 3 and the refrigerating compartment 4 becomes degraded. As a result, water is likely to be frozen at a region near the angle member 5 due to heat transfer with the freezing compartment 3, and the ice thus formed grows progressively as time elapses, which is of course undesirable.

SUMMARY OF THE INVENTION

Accordingly, it is an object of the present invention to eliminate the above-mentioned problems of the prior art sealing structure by providing an improved sealing structure for a partition wall of a thermally insulated box which is capable of physically and thermally isolating the individual compartments from each other in a satisfactory manner.

In view of the above and other objects which will be apparent as description proceeds, there is provided according to one espect of the invention a sealing structure for a partition wall of a thermally insulated box, the structure being disposed in a gap defined between an inner wall surface of a thermally insulated box and a partition wall for dividing the interior of the thermally insulated box into compartments or chambers of different temperature conditions and comprising a main body of a rigid material supported on the partition wall when the sealing structure is installed in the gap mentioned above, a plurality of seal members of a flexible or deformable material, and an engaging portion formed in the main body.

With the improved partition wall sealing structure according to the invention, the engaging portion fittingly engages the partition wall when the sealing structure is mounted in the gap intervening between an inner wall surface of the thermally insulated box and the partition wall, whereby the main body of the sealing structure is fixedly supported on the partition wall with the plurality of the seal members tightly abutting or bearing against the inner wall surface of the thermally insulated box to thereby define a plurality of mutually isolated compartments in cooperation with the main body of the sealing structure and the inner wall surface of the thermally insulated box.

BRIEF DESCRIPTION OF THE DRAWINGS .

Preferred embodiments of the invention will now be described, by way of example only, with reference to the accompanying drawings, in which.

DESCRIPTION OF THE PREFERRED EMBODIMENTS

Figure 1:
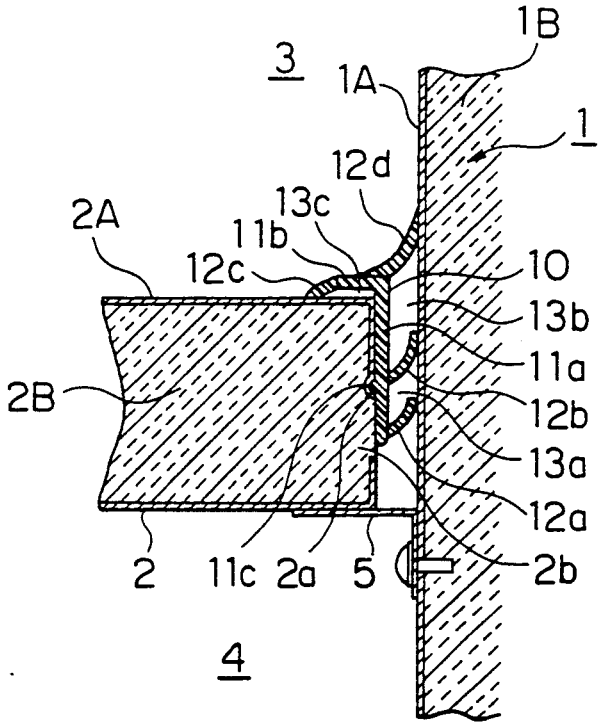
FIG. 1 is an enlarged partial sectional view showing a major portion of a partition wall sealing structure for a thermally insulated box according to an exemplary embodiment of the invention.
Figure 2:
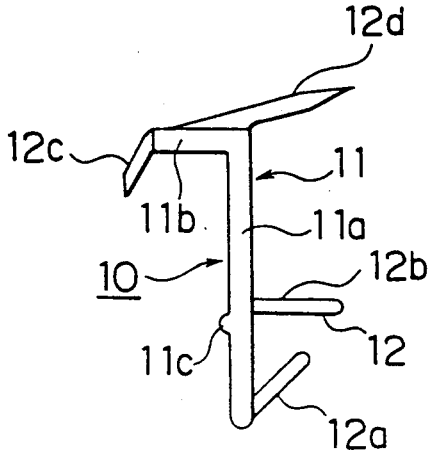
FIG. 2 is a front end view of the partition wall sealing structure shown in FIG. 1.

Now referring to the drawings, an exemplary embodiment of the partition wall sealing structure according to the invention is illustrated in FIGS. 1 and 2.

Figure 5:
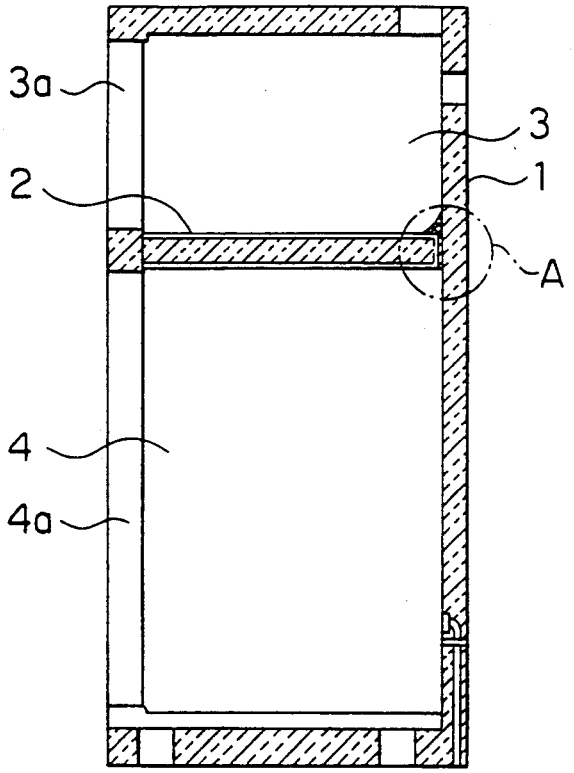
FIG. 5 PRIOR ART
FIG. 5 is a side sectional view of a freezer/refrigerator unit including freezing and refrigerating compartments sealed off from each other in a known manner.
Figure 6:
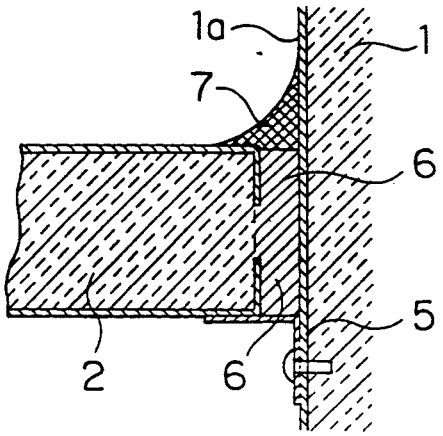
FIG. 6 PRIOR ART
FIG. 6 is an enlarged sectional view of a region indicated by a symbol A in FIG. 5.

FIG. 1 is a sectional side view showing a portion of a refrigerator having a built-in freezer, which portion corresponds to the region A shown in FIG. 5. In FIG. 1, the refrigerator including a freezer is composed of a thermally insulated box 1 having an interior space which is divided into an upper freezing compartment 3 and a lower refrigerating compartment 4 by a partition plate or wall 2 extending transversely and horizontally.

As is known in the art, the thermally insulated box 1 is constituted by an inner casing 1A, an outer casing (not shown) and a heat insulation material 1B such as a foamed plastic resin which completely fills a space defined between the inner and outer casings. The partition wall 2 is also made of a heat insulation material 2B which is enclosed by an enclosure plate 2A and has a flat and rectangular shape in outer appearance. A partition wall sealing structure 10 is disposed between the inner wall of the thermally insulated box 1 and the partition wall 2.

Referring to FIGS. 1 and 2, the partition wall sealing structure 10 comprises a main body 11 formed of a rigid material generally in a C-like frame configuration having a substantially inverted L-like section and fitted on and along both sides and the rear side of the rectangular partition wall 2, and a plurality (four in the illustrated embodiments) of fin-like seal members 12 of a flexible or elastically deformable material which extend away from the main body 11. The frame-like main body 11 of the sealing structure is composed of an inverted L-like vertical portion 11*a* and a horizontal portion 11*b* connected to the vertical portion 11*a* along the upper edge thereof so as to partially cover the peripheral portion of the partition wall 2, wherein the vertical portion 11*a* has a surface confronting the partition wall 2 which surface is formed with a protrusion 11*c* of a substantially semicircular section in the embodiment in such a manner that the protrusion 11*c* fittingly engages with the partition wall 2.

In FIG. 2, a first seal member 12*a* extends outwardly from the bottom end of the vertical portion 11*a* in the direction opposite to that of the horizontal portion 11*b* at an acute angle relative to the vertical portion 11*a*. A second seal member 12*b* extends outwardly from an outer side surface of the vertical portion 11*a* at a location in the vicinity of the protrusion 11*c* in the direction opposite to that of the horizontal portion 11*b* approximately at a right angle relative to the vertical portion 11*a*. A third seal member 12*c* extends from the top end of the horizontal web-like portion 11*b* substantially in the direction opposite to that of the first seal member 12*a* at an obtuse angle relative to the horizontal portion 11*b*. A fourth seal member 12*d* extends obliquely upwardly from the top surface of the horizontal portion 11*b* and has a substantially greater length than the other seal members 12*a* to 12*c*.

When the sealing structure 10 described above is fitted into an air gap present between the inner wall of the thermally insulated box 1 and the partition wall 2, the protrusion 11*c* is caused to engage in a recess 2*a* formed in the enclosure plate 2A of the partition wall 2, whereby the sealing structure 10 is fixedly mounted on the partition wall 2. At that time, the seal members 12*a*, 12*b* and 12*d* elastically abut or bear against the inner casing 1A of the thermally insulated box 1 with the seal member 12*c* bearing elastically on the enclosure plate 2A. As a result, there are formed hollow closed spaces 13*a*, 13*b* and 13*c*, respectively, between the first seal member 12*a* and the second seal member 12*b*, between the second seal member 12*b* and the fourth seal member 12*d* and between the third seal member 12*c* and the partition wall 2, as illustrated in FIG. 1.

Parenthetically, it should be mentioned that a cut or notch 2*b* is usually formed in the peripheral sides of the enclosure plate 2A, as shown in FIG. 1, with a view to preventing as far as possible the heat transfer from taking place between the freezing compartment 3 and the refrigerating compartment 4. Accordingly, the protrusion 11*c* of the main body 11 of the sealing structure may be so positioned as to engage an edge of the enclosure plate 2A defining the notch 2*b* in place of the recess 2*a*.

By virtue of the arrangement where the seal members 12*a*, 12*b* and 12*d* are caused to elastically abut or bear against the inner casing 1A of the thermally insulated box 1, the freezing compartment 3 and the refrigerating compartment 4 are effectively isolated from each other by the seal members 12*a*, 12*b* and 12*d*, whereby cold air is positively prevented from penetrating into the refrigerating compartment 4 from the freezing compartment 3. Also, because the seal members 12*a*, 12*b* and 12*d* define the hollow spaces 13*a* and 13*b* in cooperation with the main portion 11 and the inner casing 1A of the thermally insulated box 1, the freezing compartment 3 and the refrigerating compartment 4 are thermally insulated as well, owing to the heat insulating effect of the air resident within the hollow spaces 13*a* and 13*b*.

In the foregoing description of the sealing structure shown in FIGS. 1 and 2, it has been mentioned that the main portion 11 is designed to be a frame-like member having generally a C-like configuration in outer appearance. It should however be noted that the main portion 11 may be constructed by bar-like members rather than the frame-like member. For example, three bar-like main portions each equipped with the first to fourth seal members may be prepared and mounted in series between the inner casing 1A and both lateral sides of the partition wall 2 and the inner casing 1A.

Although the invention has been described above on the assumption that the partition wall sealing structure 10 is applied to a freezer/refrigerator unit, it should be mentioned that the invention can equally be applied to a container such as a temperature-regulated high-humidity storage box, as will be described below by reference to FIGS. 3A and 3B.

Figure 3A:
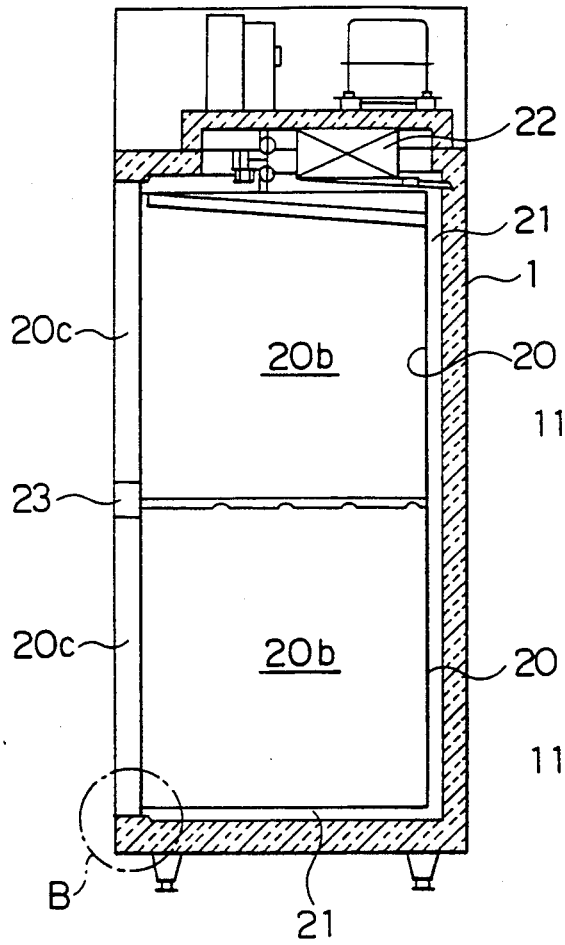
FIGS. 3A and 3B show, respectively, in a sectional side view and a front view a temperature-regulated high-humidity storage container equipped with a partition wall sealing structure implemented according to another embodiment of the invention.
Figure 3B:
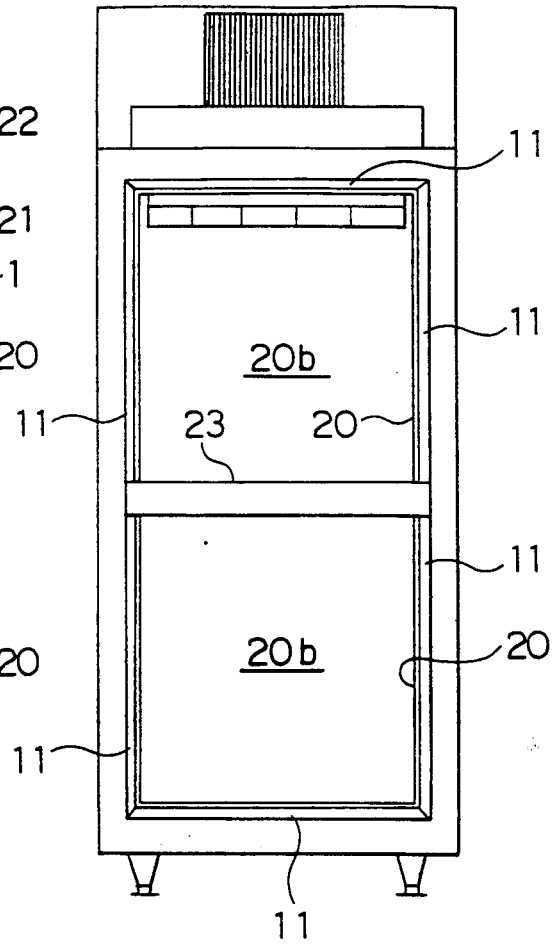

In FIG. 3A, a temperature-regulated high-humidity storage container includes a storage box 20 disposed within a thermally insulated housing 1 so that a passage 21 is formed between the storage box 20 and the thermally insulated housing 1. In other words, the interior space of the thermally insulated housing 1 is partitioned into two storage spaces 20*b* and the passage 21 by the walls of the storage box 20 which can thus be said to also serve as partition walls. By feeding the cold air from a cooler 22 through the passage 21, the interior of the storage box 20 is cooled by heat transfer taking place through the walls of the box 20 to be thereby maintained at a regulated constant temperature with high humidity. Since the structure of such a temperature-regulated high-humidity storage container itself is well known, any further description thereof will be unnecessary.

As is apparent, unless the sealing structure such as described above is provided, the passage 21 will be communicated to the openings 20*c* at regions other than a region extending along a frame member 23. For this reason, the sealing structure 10 of the C-like frame configuration may be mounted at regions other than that extending along the frame member, as shown in FIG. 3B.

Figure 4:
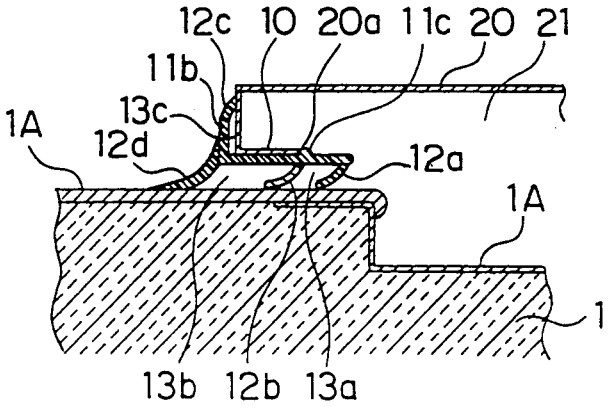
FIG. 4 is an enlarged sectional view of a region indicated by symbol B in FIG. 3A.

In the case of the temperature-regulated high-humidity storage container, the manner in which the sealing structure 10 is mounted is substantially the same as described previously in conjunction with FIGS. 1 and 2. More specifically, referring to FIG. 4 which shows representatively a region B of FIG. 3A on an enlarged scale, the sealing structure 10 according to the invention is fitted between an inner casing 1A of the thermally insulated box or housing 1 and the storage box 20. When the sealing structure 10 is fitted in this manner, the protrusion 11*c* is caused to engage an edge 20*a* of an L-shaped bent end portion of the storage box 20 (alternatively, the protrusion 11*c* may be engaged in a recess formed in the bent end portion of the storage box 20) to thereby fixedly mount the sealing structure on the storage box 20. As a result, the seal members 12*a*, 12*b* and 12*d* are forced to elastically bear against the inner casing 1A, while the seal member 12*c* is caused to elastically bear against the outer surface of the bent end portion of the storage box 20, whereby the interior of the storage box 20 is isolated from the passage 21 through which the cold air flows. In this respect, it should also be mentioned that instead of realizing the sealing structure 10 in the C-like frame configuration, it may be constituted by a plurality of bar-like members each equipped with the elastically deformable or flexible seal members.

In the embodiments of the invention described above, the frame-like main body of the sealing structure is provided with four flexible or elastically deformable seal members. It should however be understood that the number of such seal members may be appropriately determined in dependence on the degree of thermal and physical isolation desired between the two compartments or spaces. Also, the sectional shape of the frame-like body of the sealing structure is not restricted to the inverted L-like configuration. By way of example, the horizontal body portion may be eliminated. Further, although the protrusion has been described as being formed on the frame-like main body, it may be provided on the partition wall, while the recess in which the protrusion is to be engaged is formed in the frame-like main body.

Although the foregoing description has been made on the presumption that the invention is applied to the freezer/refrigerator unit or a temperature-regulated high-humidity storage container, it goes without saying that the teachings of the invention can equally be applied to other thermally insulated containers of which the interior is partitioned into compartments by one or more partition walls.

As will now be appreciated from the foregoing, the partition wall sealing struture according to the invention which features the frame-like main body of a rigid material, a plurality of flexible or elastically deformable seal members extending outwardly from the main body and engaging means provided in association with the main body can easily be installed through a simple procedure for isolating thermally and physically the individual compartments formed inside of a thermally insulated box in a satisfactory manner.

It is thought that the invention and many of its attendant advantages will be understood from the foregoing description and it will be apparent that various changes may be made in the form, construction and arrangement thereof without departing from the spirit and scope of the invention or sacrificing all of its material advantages, the form hereinbefore described being merely a preferred or exemplary embodiment thereof.

I claim:

1. An elongated sealing structure for sealing a gap between walls in a refrigerator or the like consisting of a rigid main body and a plurality of flexible sealing members and having the following cross-sectional profile throughout the length of the structure:

an L-shaped main body portion comprising a longer leg and a shorter leg;

a first sealing member extending from an end of said longer leg in a direction generally opposite to the direction in which said shorter leg extends from said longer leg and forming an acute angle with said longer leg;

a second sealing member extending normally outward from said longer leg in generally the same direction as said first sealing member;

a third sealing member extending from an end of said shorter leg in a direction generally opposite to that of the first seal member at an obtuse angle to said shorter leg; and a fourth sealing member extending obliquely from said shorter leg, said fourth sealing member having a substantially greater length than said other sealing members when viewed in profile.

2. The sealing structure of claim 1 and including a rounded protrusion on said first leg for engaging a recess.

3. A sealing structure adapted to be inserted into a gap between a wall surface of a thermally insulated box and a parallel first surface of a partition wall mounted within, and for dividing the interior space of said thermally insulated box into a plurality of chambers of different temperature conditions for isolating said chambers from one another in a sealed state, said partition wall having a second surface extending perpendicular to its said first surface and said gap being open for so inserting said sealing structure substantially from said second partition wall surface and in direction parallel to the first said partition wall surface, said sealing structure having the following cross-sectional profile throughout the length of the structure:

a rigid main body portion having upper and lower ends and opposite first and second side surfaces and whose dimension between said surfaces is less than the width of said gap, said first main body portion side surface being substantially straight and flat for disposition against said partition wall first surface when said structure is so inserted into said gap;

wall engaging means on said first main body portion side surface for interlocking engagement with said first surface of said partition wall for positioning said structure within said gap when said structure is so inserted into said gap; and a plurality of flexible seal portions projecting from said second main body portion side surface in spaced apart relation to each other for spanning said gap and elastically sealing against said wall surface when said structure is so inserted in said gap, one of said seal members projecting substantially from said upper end of said main body portion at an obtuse angle with respect to said second main body portion side surface and having length greater than that of any other of said seal portions, a second of said seal members projecting substantially from said lower end of said main body portion at an acute angle with respect to said second main body portion side surface, and at least one of said seal members between said first and second seal members.

4. A sealing structure according to claim 3, which further includes a second upper end flexible seal member of said main body portion projecting in direction substantially opposite to said one seal member for elastically sealing against said partition wall second surface when said sealing structure is so inserted into said gap.

5. A sealing structure adapted to be disposed in a gap between a wall surface of a thermally insulated box and a partition wall for dividing the interior space of said thermally insulated box into a plurality of chambers of different temperature conditions for isolating said chambers from one another in a sealed state, comprising:

a rigid main body portion having upper and lower ends and a flat surface therebetween on one side thereof for engagement with said partition wall when said structure is so disposed in said gap;

a plurality of flexible seal members projecting from the opposite side of said main body portion for spanning said gap and elastically abutting against said wall surface;

a flexible single seal member projecting from said one side of said main portion at its said upper end in a direction substantially opposite to the direction of projection of said plurality of flexible seal portions; and engaging means on said flat surface for causing said main body portion to engage said partition wall when said sealing structure is so disposed in a gap;

said main body portion having a substantially inverted L-like outer shape which includes an upper horizontal rigid portion carrying said single flexible seal member and a lower vertical rigid portion extending downwardly from an end of said horizontal portion and carrying said plurality of flexible seal members whereby, when said sealing structure is so disposed in said gap, said single seal member projecting from said horizontal portion abuts elastically on a surface of said partition wall while said plurality of seal members projecting from said vertical portion abut elastically on said wall surface.

* * * * *